US005259375A

United States Patent [19]

Schuler

[11] Patent Number: 5,259,375

[45] Date of Patent: Nov. 9, 1993

[54] SECOND STAGE SCUBA REGULATOR WITH BALANCED PISTON VOLUME CONTROL

[76] Inventor: Manfred Schuler, 17462 Wayne Ave., Irvine, Calif. 92714

[21] Appl. No.: 901,406

[22] Filed: Jun. 19, 1992

[51] Int. Cl.[5] ..... A62B 7/04

[52] U.S. Cl. ..... 128/205.24; 128/204.26; 137/315; 137/908

[58] Field of Search ..... 128/202.24, 204.18, 128/204.26, 205.22, 205.24, 207.12; D29/7, 8; 137/505.47, 508, 510, 494, 908, 269, 315, 271; 251/244, 282, 291, 325, 331, 367

[56] References Cited

U.S. PATENT DOCUMENTS

| | | | |
|---|---|---|---|
| 3,783,891 | 1/1974 | Christianson | 128/204.26 X |
| 4,140,112 | 2/1979 | Kobzan | 128/204.26 X |
| 4,214,580 | 7/1980 | Pederson | 128/204.26 |
| 4,266,538 | 5/1981 | Ruchti | 128/204.26 |
| 4,437,460 | 3/1984 | Glynn | 128/204.26 |
| 4,446,859 | 5/1984 | Pedersen | 128/204.26 |
| 4,630,605 | 12/1986 | Pasternack | 128/205.24 |
| 4,850,346 | 7/1989 | Michel | 128/206.15 |
| 4,966,196 | 10/1990 | Meyer | 137/625.64 |
| 5,035,238 | 7/1991 | Christianson | 128/204.26 |

FOREIGN PATENT DOCUMENTS

| | | | |
|---|---|---|---|
| 2646338 | 4/1978 | Fed. Rep. of Germany | 128/204.26 |
| 3426143 | 6/1985 | Fed. Rep. of Germany | 128/204.26 |
| 228774 | 9/1943 | Switzerland | 128/204.26 |
| 1569875 | 6/1980 | United Kingdom | 128/204.26 |

*Primary Examiner*—Edgar S. Burr
*Assistant Examiner*—Eric P. Raciti
*Attorney, Agent, or Firm*—Walter A. Hackler

[57] ABSTRACT

A second stage scuba regulator is provided which includes inlet for receiving a supply of compressed air and a piston valve in communication with the inlet for causing air flow through the regulator when the piston valve is opened. A lever is provided for opening and closing of the piston valve, and an air volume controller is provided, which is independently operable from the lever for varying the amount of air flow through the regulator when the piston valve is opened by the lever.

22 Claims, 5 Drawing Sheets

FIG. 1.
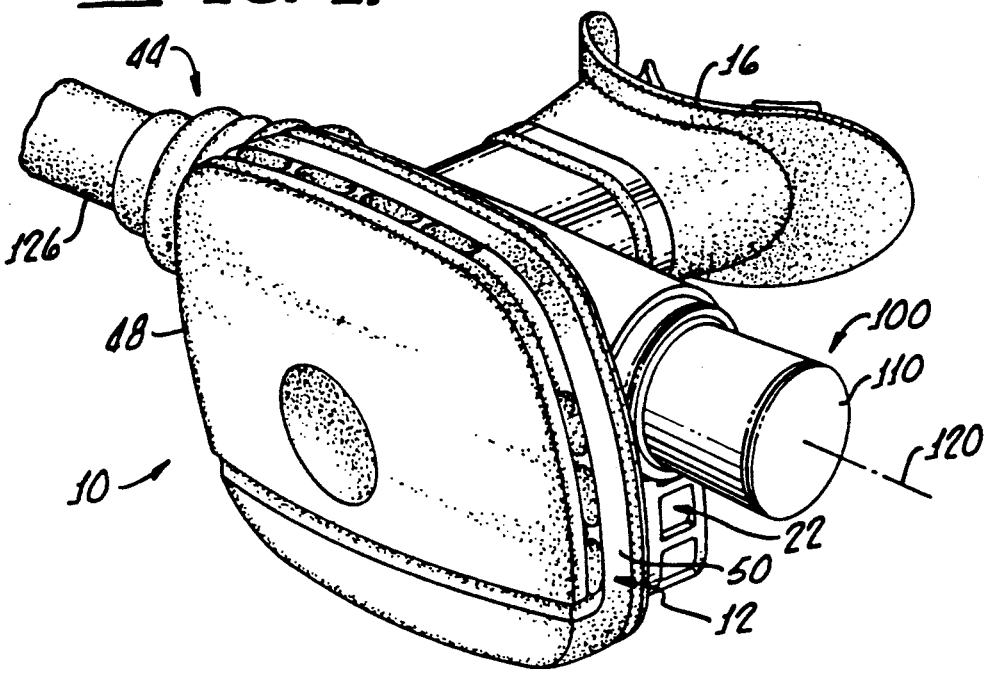
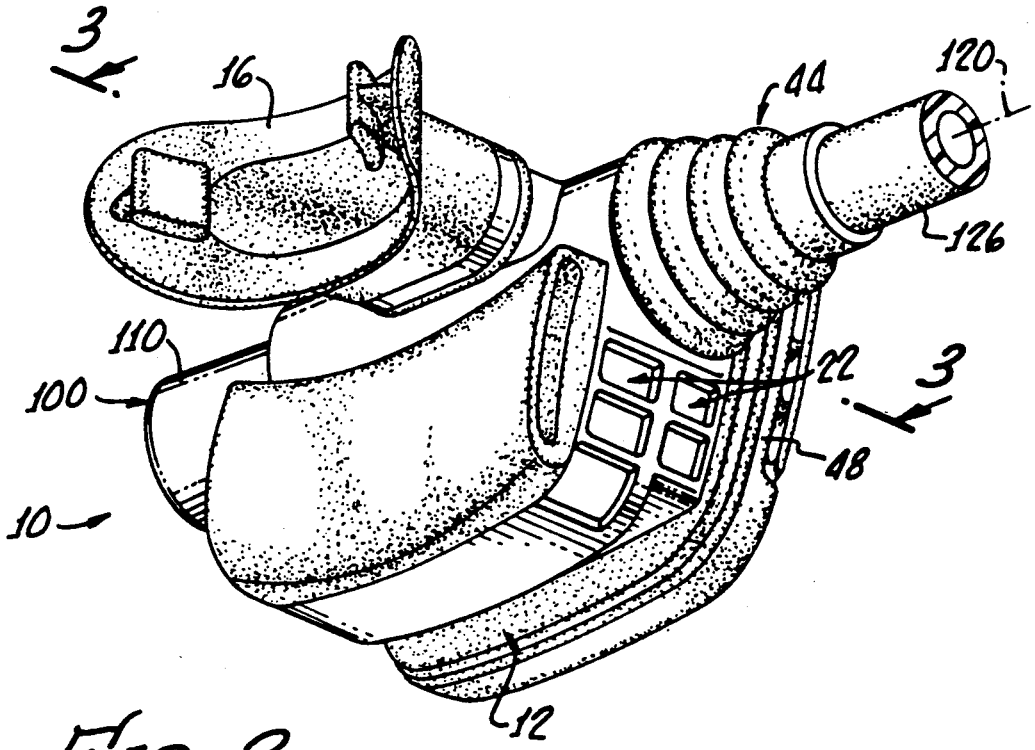
FIG. 2.

FIG. 3.
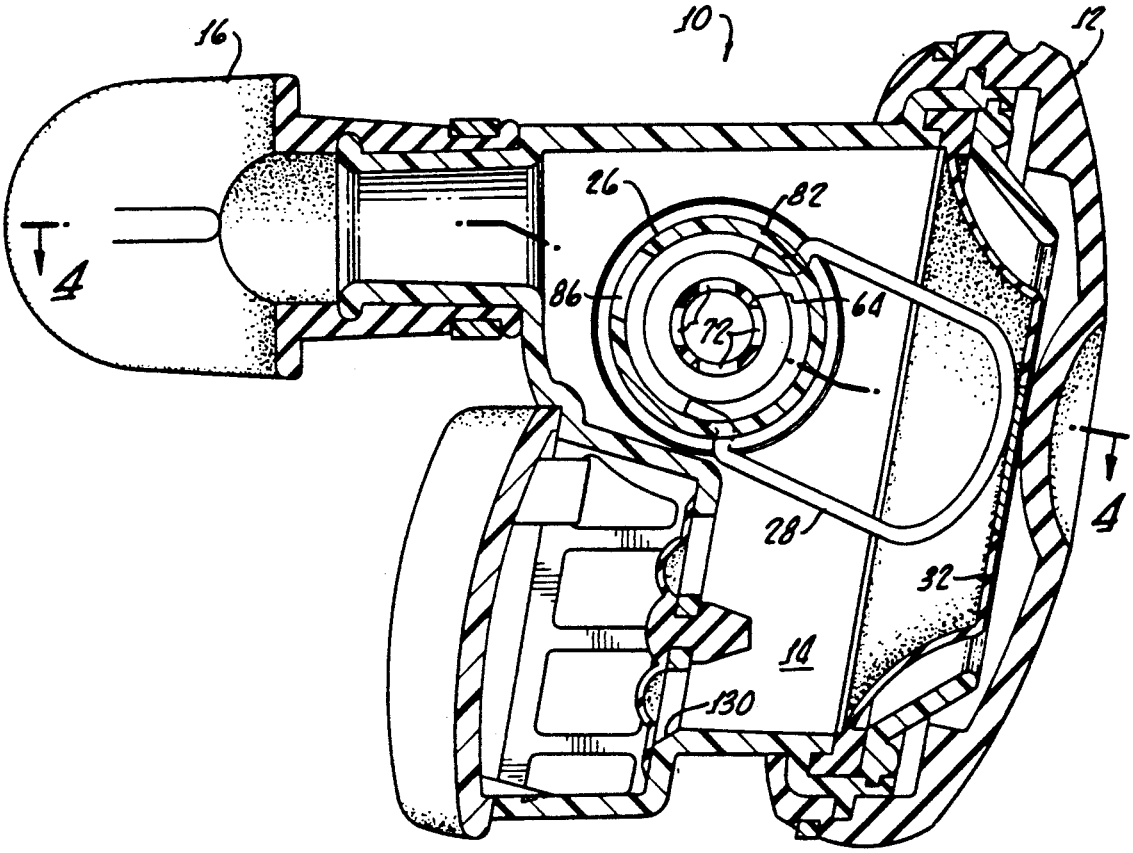
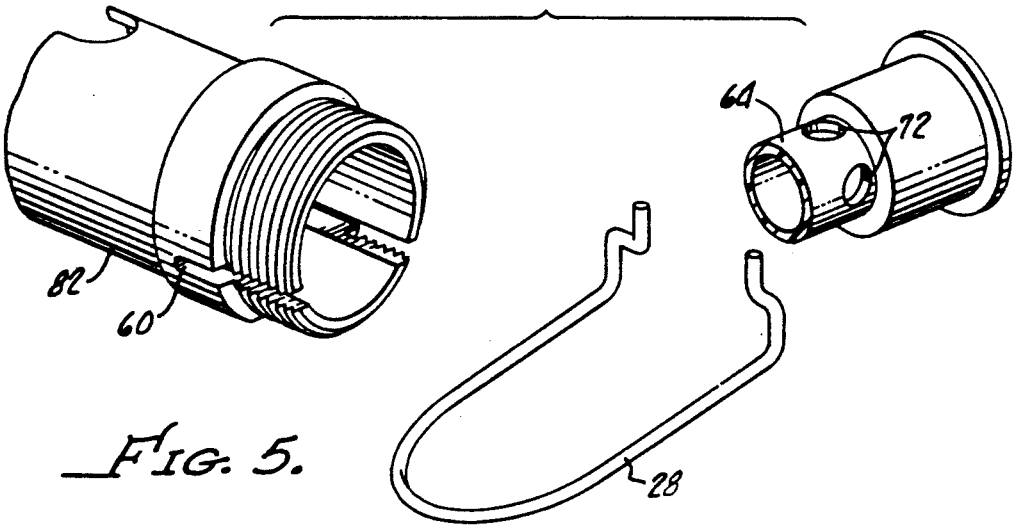
FIG. 5.

SECOND STAGE SCUBA REGULATOR WITH BALANCED PISTON VOLUME CONTROL

The present invention is particularly addressed to self-contained breathing systems, such as those used in scuba diving equipment and more specifically to a second stage scuba regulator enabling the user to adjust the volume of air provided by the regulator in response to diver inhalation.

Pressure regulation of gas or air is an area of continued research and improvement despite its common usage throughout the years.

Unique, however, in this area is the regulation of air flow in self-contained underwater breathing apparatus.

In particular, second stage regulator apparatus for scuba diving equipment typically incorporates a valve mechanism which utilizes a pressure differential on opposite sides of a flexible diaphragm to operate an air valve for supplying air to a breathing chamber from which the diver/user inhales. In this typical system, when the diver/user inhales, the inhalation pressure differential causes a diaphragm to deflect and thereby operate a lever for allowing an air inlet valve to open. Upon exhalation by the diver/user, pressure in the breathing chamber increases, causing a diaphragm to reverse its deflection, thereby closing the air inlet valve, and air exhaled into the breathing chamber is vented through a one-way exhaust valve.

Prior art devices have been developed -to enable a diver/user to regulate or set the inhalation resistance necessary to displace the diaphragm for opening and closing the air valve. In this manner, the diver/user has the freedom to adjust, on a personal basis, the inhalation resistance, thus making it easier or harder for an individual diver/user to inhale air from the regulator.

While these prior art devices make an attempt to customize the equipment to the breathing requirements for each diver/user, particularly dependent upon the diving depth and/or exertion of the diver/user, the prior art devices and investigators have ignored an important parameter in the breathing requirements for the diver/user. This is particularly important for a diver/user wishing to operate at various depths and amounts of exertion, thereby changing the parameters for the diver's degree of breathing facility.

Without comprehending the problems particularly directed to the scuba diver, devices have been developed which employ a venturi-type of action to assist in responding to the breathing demand of the diver. Design considerations in development of these devices have addressed various ways of altering the venturi action in the regulator.

The venturi action is primarily directed to the amount of inhalation resistance the diver/user experiences. Totally ignored in prior art devices is the volume of air provided to the diver/user once the inhalation resistance has been overcome.

The inhalation resistance is important for the degree of exertion controlling the diver/user's adjustment breathing exertion which can vary, depending upon the diver/user's position in the water. For example, in a head up position or use of the equipment in surf or heavy currents, a change in the inhalation resistance adjustment may eliminate any "air surge" due to water impact deflecting the diaphragm.

Despite the variance in inhalation resistance, which may be altered in accordance with prior art devices, it is important to realize that another factor independent of the breathing resistance is the amount of air that the diver requires during particular underwater circumstances or exertion.

The importance of the independent factors of air volume vs. inhalation resistance has not been recognized nor addressed by any prior art device and represents a unique problem particular only to second. stage scuba regulators.

The present invention particularly recognizes and addresses this problem. A second stage scuba regulator is provided in accordance with the present invention for enabling air volume control independent of air inhalation resistance adjustment.

SUMMARY OF THE INVENTION

In accordance with the present invention, a second stage regulator generally includes inlet means for receiving a supply of compressed air, and piston valve means include communication with the inlet means for causing air flow through the regulator when the piston valve means is open.

The opening and closing of the piston valve is controlled by lever means and air volume control means is provided for varying the amount of air flow through the regulator when the piston valve means is opened by the lever means. Importantly, the air volume control means is independently operable from the lever means. Thus, the air volume desired, or required, by the diver/user may be adjusted independently of the lever means which, as hereinafter set forth, can be adjusted to regulate the inhalation resistance required for opening and closing the piston valve means.

More particularly, the piston valve means includes a hollow body and the piston valve means is disposed in fluid-communication with the inlet means for causing the air flow through the piston hollow body. The piston valve hollow body is sized so that a pressure balance is achieved. That is, the incoming air supply pressure does not exert its full pressure on the valve body. Hence, only minimum spring force is required to maintain closure of the valve. On the other hand, since the valve has a hollow body, upon opening of the valve, no substantial increase in pressure is experienced which again allows a lower spring force to control valve operation. Further, as will be discussed hereinafter, excess pressure from the source, caused by failure of a first state pressure regulator, will not increase the closing force of the valve, as is the case with prior art valves, but will advantageously open the valve. Again, this provides an additional safety feature not provided by the prior art.

With particular reference to the volume control means, there is included in the present invention stem means disposed within the piston hollow body for partially occluding the outlet in the hollow body in order to vary the amount of air flow through the piston valve hollow body.

Manually operative means are provided for moving the stem means within the piston hollow body in order to change the amount of occlusion of the outlet when the lever means opens the piston valve means.

In order to avoid a labyrinth required by prior art devices for preventing undesired impingement of air released by the piston valve means, a piston sleeve is provided which surrounds a piston valve means which includes an air outlet therein, including communication with the piston hollow body outlet for passing air from the balanced piston breathing apparatus to the surrounding area. Specifically, the direct discharge of air from the piston hollow body outlet to the surrounding area is prevented by an arrangement of the preset-it invention in which the piston sleeve outlet and the piston hollow body outlet are not aligned with another.

In order to independently change the inhalation resistance, means are provided for changing the amount of force necessary to operate the lever means.

To provide ease of use to the diver/user, the inlet means may include swivel means for enabling air to be introduced into the balanced piston breathing apparatus at an angle to the regulator centerline.

Also encompassed by the present invention is scuba regulator apparatus which also includes housing means for defining a breathing chamber, and a mouthpiece includes communication with the breathing chamber, together with outlet means for exhausting air from the housing means.

Balanced piston breathing apparatus is provided for controlling the air flow from a pressurized source to the breathing chamber and mouthpiece, with the balanced piston breathing apparatus being removably attached to the housing through opposing openings therein. The breathing apparatus includes inlet means disposed on one end thereof for receiving air from a pressurized source, with the inlet means being disposed outside of the housing means when the breathing apparatus is attached to the housing means through the opposing housing means openings. In accordance with the present invention, the breathing apparatus is symmetrically sized for enabling the inlet means to be disposed outside either of the opposing housing means opening when the breathing apparatus is attached to the housing means through the opposing housing means openings.

This reversibility feature of the present invention adds significant convenience to the diver/user because the positioning of the inlet air tubes may be more convenient on either the right or left side of the user's head, depending upon the right- or left-handed dexterity of the diver/user.

Further, the breathing apparatus may include lever means for starting and stopping of air flow from the pressurized source into the breathing chamber and mouthpiece in operational contact with a diaphragm extending across the housing for enabling the diaphragm to operate the lever means in response to inhalation by a diver/user through the mouthpiece.

An exhaust opening is provided in the housing wall which is disposed at a position enabling the complete drainage of condensation within the breathing chamber. This is an important feature of the present invention not provided by the prior art and overcomes the problem of condensation accumulated in prior art devices heretofore experienced.

BRIEF DESCRIPTION OF THE DRAWINGS

A better understanding of the present invention may be had from the consideration of the following detailed description, taken in conjunction with the accompanying drawings, in which:

FIGS. 1 and 2 are perspective views of the present invention showing in general the housing of the outlet and certain portions of a regulator;

FIG. 3 is a cross-sectional view of the breathing apparatus in accordance with the- present invention;

FIG. 5 is an enlarged, exploded view showing a lever/pivot arrangement for opening and closing a regulator valve;

DETAILED DESCRIPTION

Figure 4:
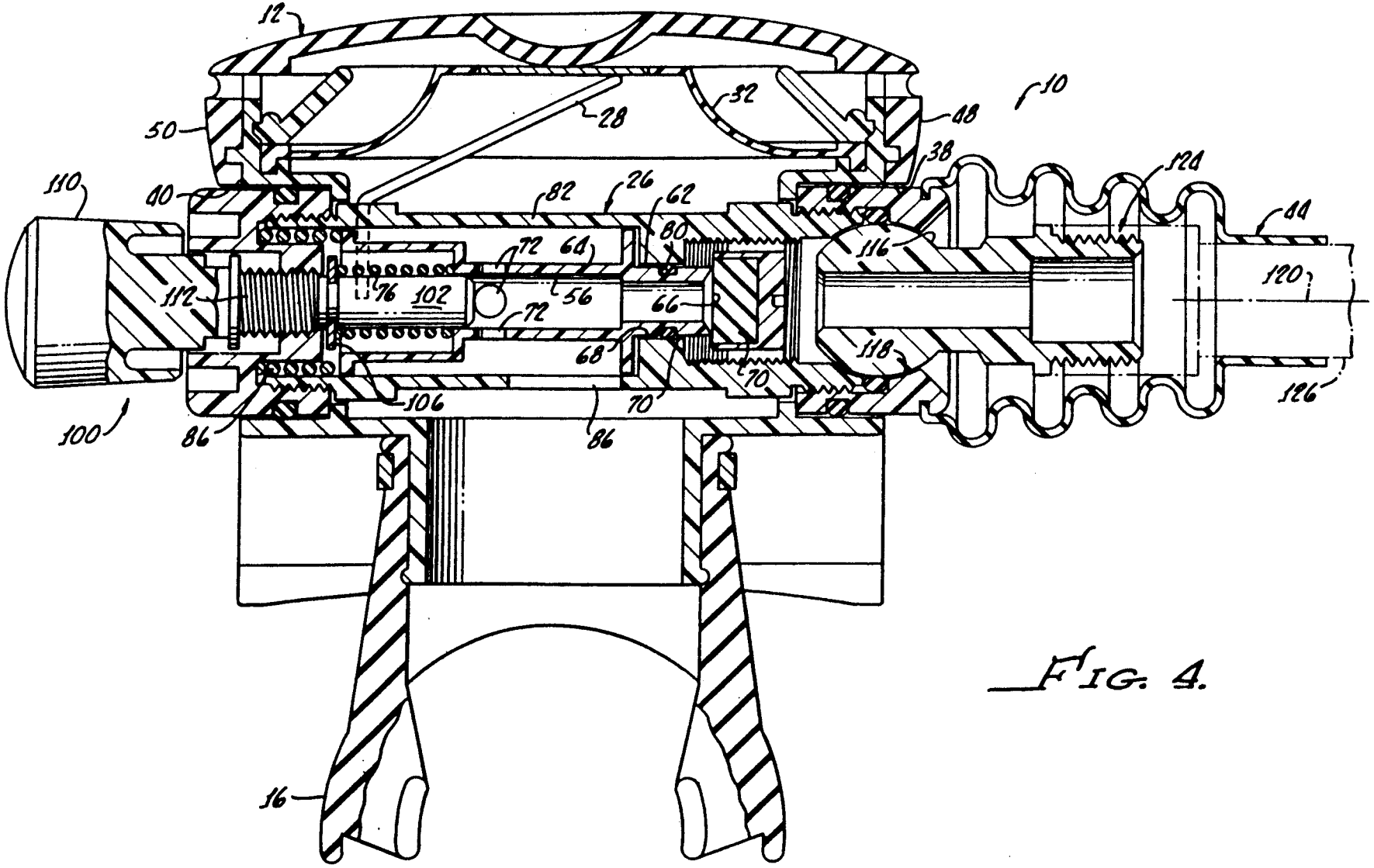
FIG. 4 is a cross-sectional view of the apparatus in accordance with the present invention taken along the line 4—4 of FIG. 3.

Turning now to FIGS. 1–4, there is shown a regulator 10 in accordance with the present invention, generally including a housing 12, which provides means for defining a breathing chamber 14 therein, which is in fluid communication with a mouthpiece 16.

As more clearly shown in FIGS. 2 and 3, an outlet 22 provides means for exhausting air from the housing 12 and breathing chamber 14.

As more particularly described hereinafter, a balanced piston breathing apparatus 26 provides means for controlling air flow from a pressurized source, not shown, to the breathing chamber 14 and mouthpiece 16. A lever 28 provides a means for starting and stopping air flow from the pressurized source into the breathing chamber 14 and mouthpiece 16 and the housing 12 further includes a diaphragm 32 extending across the housing 12 and in operational contact with the lever 28 for enabling the diaphragm 32 to operate the lever 28 in response to inhalation by a user (not shown) through the mouthpiece 16. The housing 12, mouthpiece 16, apparatus 26, lever 28, and diaphragm 32 may be formed from any material suitable for use in scuba breathing apparatus, as is well known in the art.

The balanced piston breathing apparatus 26 is removably attached to the housing 12 through opposing openings 38, 40.

Because of the symmetry of the breathing apparatus 26 and housing 12 with opposing openings 38, 40, the breathing apparatus 26 may be installed into the housing 12 in a reversed manner, (Compare FIG. 7 and FIG. 8) thereby enabling a regulator inlet 44 to be disposed on and extending from one side 48 of the housing or another side 50 of the housing. This feature enables a user (not shown) to configure the regulator 10 so as to suit his or her personal preference. The regulator inlet 44 provides a means for receiving a supply of compressed air and is in fluid communication with a piston valve 56. The piston valve 56 causes air to flow through the balanced piston breathing apparatus 26 when the piston valve means is open, as will be hereinafter described in greater detail.

The lever 28, as hereinabove described, provides a means for opening and closing the piston valve means.

Depression of the lever 28, caused by inhalation of a user, and the collapse of the diaphragm 32 thereon moves by way of a pivot 60 (see FIG. 5) to move a piston valve body 64 so that an open end 66 thereof separates from a seat 70, thereby enabling air flow through the piston hollow body 64, which is discharged from an opening 72.

Upon exhalation of the diver/user, a spring 84 urges the open end 66 of the piston valve hollow body 64 against the seat 70. O-ring 80 provides a seal between the piston valve hollow body 64 and a piston valve frame 82 surrounding the piston valve hollow body 64.

In addition, an exterior diameter 62 of the piston valve body 64 is sized in relation to a face 68 through a piston valve frame 82 in order to minimize pressure on the piston valve body 64 to provide a piston valve body 64, "balanced" in pressure. That is, in a closed position, the supply of compressed air does not exert significant "opening" pressure on the piston valve body 64. On the other hand, substantially increased supply pressure will not increase the closing force of the piston valve body 64, but will, in fact, cause an opening of the piston valve body 64, thus acting as a relief pressure valve.

It can be seen from FIG. 4 that when the valve body 64 is seated against the seat 70, supply air pressure is exerted almost equally in a space 74 between the face 68, exterior diameter 62, seat 70 and O-ring 80. Therefore, little pressure is applied to the valve body 64 for opening thereof. However, because the face 68 is slightly larger than the body exterior 62, over-pressure, which may be caused by a failure of a first stage regulator (not shown) in the air supply, will cause reward, or opening, movement of the valve body 64, thus providing a relief valve function. Also, the hollow configuration of the piston valve body 64 causes no significant air differential, or pressure, exerted thereon when unseating occurs for the passage of air therethrough. Further, because of the piston seat 70 arrangement, excessive over-pressure from the pressured source will not increase the force necessary to open the piston valve as is the case with prior art regulators.

An optional auxiliary spring 76 may be provided and, in combination with a spring 86, may provide a means for changing the amount of force necessary to operate the lever 28. In this manner, the user's inhalation resistance can be controlled. That is, the amount of suction necessary for the user to draw in order to move the lever 28 for opening the piston valve 56 can be selectively varied.

In order to pass air from the balanced piston breathing apparatus 26 and into the air chamber 14 in a non-turbulent or non-direct impingement manner, a piston valve sleeve 82 includes an opening 86 which is purposely not aligned with the discharge opening 72 in the hollow piston body 64, so that an air stream, as represented by the arrow 88, does not directly impinge the air chamber 14.

A most important feature of the present invention is an air volume control 100, which provides means, independently operable from the opening and closing of the piston valve by the lever 28, for varying the amount of air flow through the apparatus 26 when the piston valve 56 is opened by the lever 28.

Figure 6:
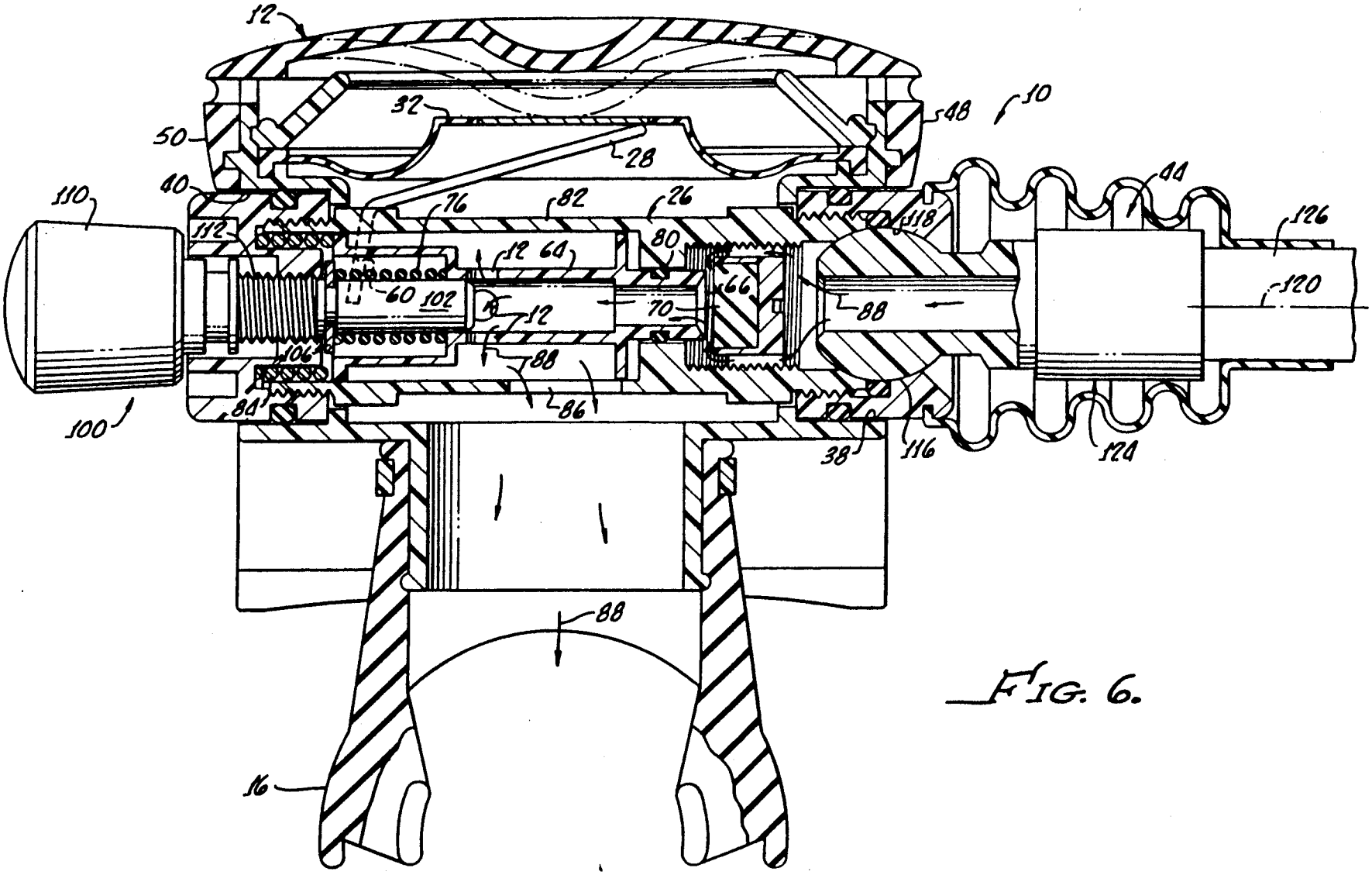
FIGS. 6 and 7 are cross-sectional views of the present invention showing the operation of the volume control for enabling independent control of air volume through a balanced piston breathing apparatus independent of inhalation resistance.
Figure 7:
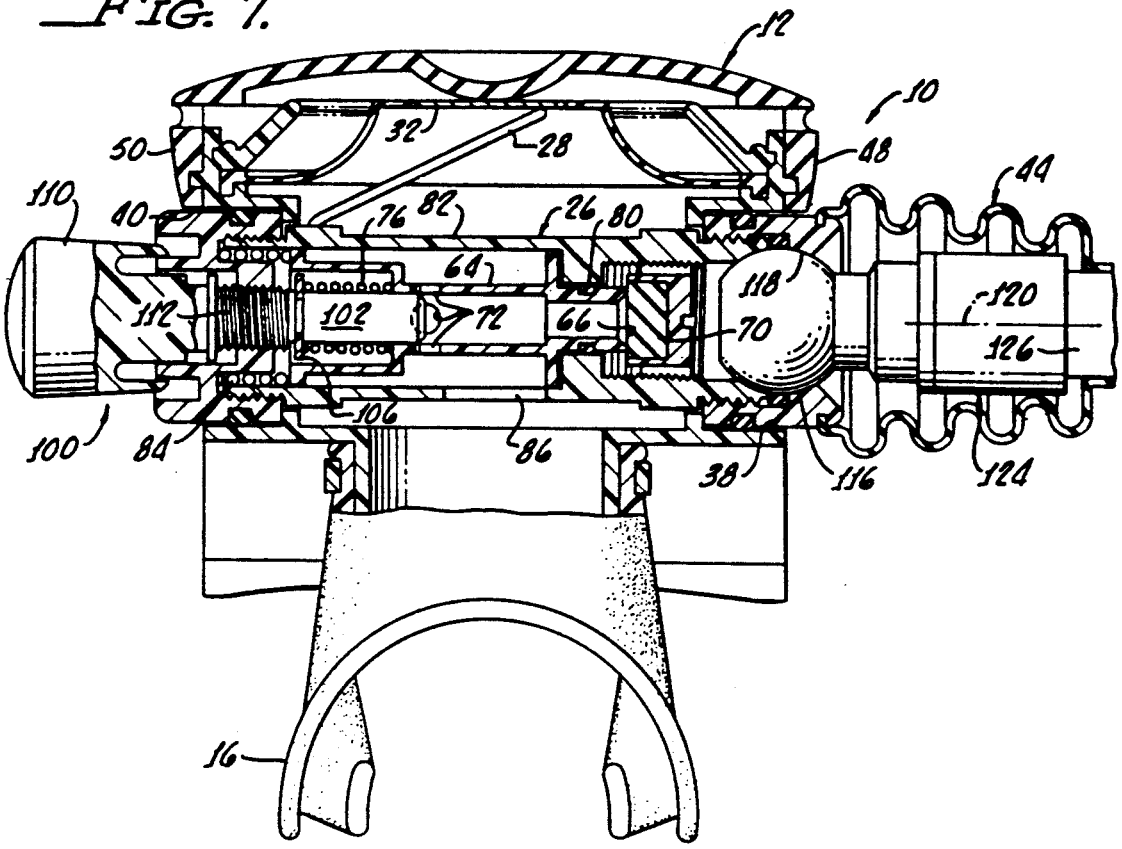
Figure 8:
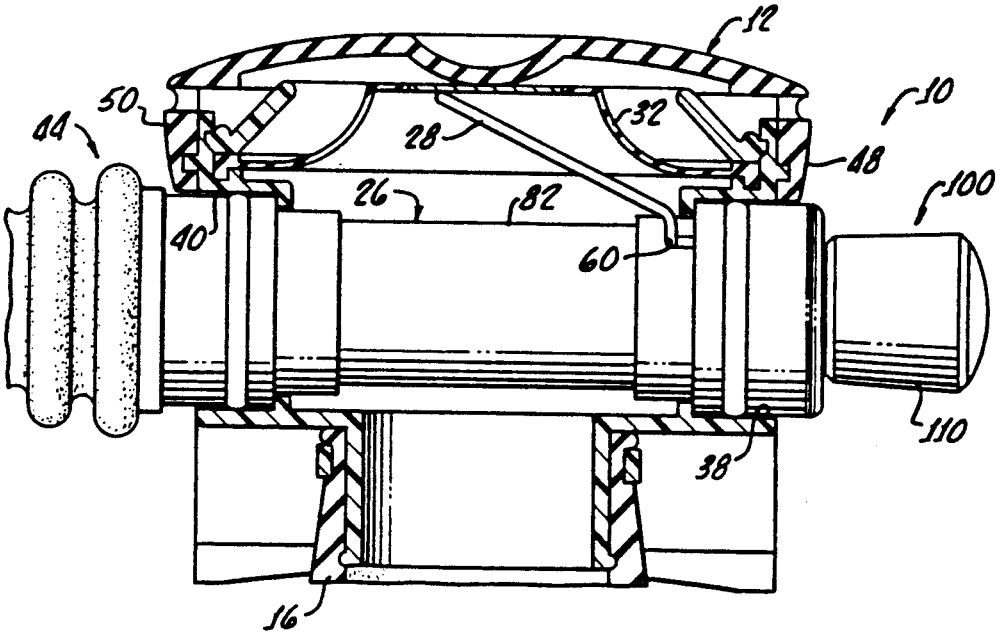
FIG. 8 is a partial cros-section view corresponding to FIG. 7 in which the regulator is shown in a reversed position in the housing as hereinafter described.

As shown in cross-section in FIGS. 6 and 7, the volume control 100 generally includes a stem 102, disposed within the piston hollow body 64 for occluding the discharge opening 72 in order to vary the amount of air flow through the hollow body 64 upon opening of the piston valve 56. The stem 102 is secured by a snap ring 106 and interconnected to the knob 110 through a threaded portion 112 so that rotation of the knob 110 will adjust the relative position of the stem 102 with regard to the discharge opening 72, thereby varying the occlusion thereof when the piston valve 56 is opened by the lever 28. The position of the stem 102 is independent of movement of the piston valve hollow body 64 therealong, upon opening of the piston valve 56 by the lever 28.

Thus, the balanced piston breathing apparatus 26, in accordance with the present invention, not only allows the user to vary the inhalation resistance by a change in the spring pressure 76, but independently thereof enables the user via the knob 110 exterior to the housing 12 to adjust the amount of air flow through the apparatus 26 at any selected inhalation resistance.

As hereinabove set forth, because the apparatus 26 may be selectively disposed in the openings 38, 40 of the housing 12 so that the knob 110 may protrude from either one side 48 of the housing 12 or the other side 50 of the housing 12, convenience is afforded the user.

A further feature of the present invention resides in the regulator inlet 44 which includes the ball 116 and socket 118 arrangement to provide a "swivell"-type means to enable air to be introduced into the apparatus 26 at an angle to the apparatus centerline.

As shown, the inlet 44 may include any conventional coupling for enabling the inlet 44 to be attached to any standard-type delivery tube, or conduit, 126.

As most clearly shown in FIG. 3, an exhaust opening 130 in the housing 12 which is disposed in a position enables the complete drainage of condensation/water which may occur within the breathing chamber 14. This must be contrasted with prior art devices in which an emulation of condensation is most common and, in many cases, poses an interfering problem with proper breathing by the diver/user.

Although there has been hereinabove described a balanced piston breathing apparatus and regulator in accordance with the present invention, for the purpose of illustrating the manner in which the invention may be used to advantage, it should be appreciated that the invention is not limited thereto. Accordingly, any and all modifications, variations., or equivalent arrangements which may occur to those skilled in the art, should be considered to be within the scope of the present invention as defined in the appended claims.

What is claimed is:

1. A balanced piston breathing apparatus comprising:
inlet means for receiving a supply of compressed air;
piston valve means, in fluid communication with said inlet means, for causing air flow through the regulator when said piston valve means is opened;
lever means for opening and closing said piston valve means; and
air volume control means for varying the amount of air flow through the regulator when said piston valve means is opened by said lever means, said lever means and the air volume control means being operable independent from each other.

2. The apparatus according to claim 1 wherein said piston valve means comprises a hollow body and the piston valve means is disposed in fluid communication with said inlet means for causing air flow through the platen hollow body, said hollow body comprising means defining an outlet therein for the air flow therethrough.

3. The apparatus according to claim 2 further comprising seat means for sealing the piston valve means, said piston valve means being sized so that required opening and closing forces are generally independent of the air pressure of compressed air supply.

4. The apparatus according to claim 2 wherein said air volume control means comprises stem means, disposed within said piston hollow body, for occluding the outlet in order to vary the amount of air f low through the hollow body.

5. The apparatus according to claim 3 wherein said air volume control means comprises means for moving said stem means within said piston hollow body in order to change the amount of occlusion of the outlet where said lever means opens the piston valve means.

6. The apparatus according to claim 5 wherein said inlet means comprises swivel means for introducing air into the apparatus at an angle to an apparatus centerline.

7. The apparatus according to claim 5 further comprising means for changing an amount of force necessary to operate the lever means.

8. The apparatus according to claim 5 further comprising a piston sleeve surrounding said piston valve means and including means, defining an air outlet therein in fluid communication with the piston hollow body outlet, for passing air from the apparatus to a surrounding area and preventing direct discharge of air from the piston hollow body outlet to the surrounding area.

9. The apparatus according to claim 5 wherein the piston sleeve outlet and the piston hollow body outlet are not facing one another.

10. A scuba regulator comprising:

housing means for defining a breathing chamber, said housing means including opposing openings therein;

a mouthpiece in fluid communication with said breathing chamber;

outlet means for exhausting air from said housing means;

balanced piston means for controlling air flow from a pressurized source to said breathing chamber and mouthpiece, said balanced piston means being removably attached to said housing means through the opposing openings therein, and balanced piston means including inlet means, disposed on one end thereof, for receiving air from said pressurized source, said inlet means being disposed outside of said housing means when said balanced piston is attached to the housing means through the opposing housing means openings; and means for enabling the inlet means to be disposed outside either of the opposing housing means opening when the balanced piston means is attached to the housing means through the opposing openings.

11. The regulator according to claim 10 wherein said balanced piston means further comprises lever means for starting and stopping air flow from said pressurized source into said breathing chamber and mouthpiece, and said housing means further comprises diaphragm means, extending across said housing means and in operational contact with said lever means, for enabling the diaphragm to operate said lever means in response to inhalation by a user through said mouthpiece.

12. The regulator according to claim 11 wherein said outlet means comprises exhaust opening means, disposed in the housing means for enabling complete drainage of condensation/water within the breathing chamber.

13. The regulator according to claim 10 wherein said balanced piston means further comprises piston valve means, in fluid communication with said inlet means,, for causing air flow through the balanced piston when said piston valve means is opened; lever means for opening and closing said piston valve means; and air volume control means, independently operable from said lever means, for varying the amount of air flow through the balanced piston when said piston valve means is opened by said lever means; and said housing means further comprises diaphragm means, extending across said housing means and in operational contact with said lever means, for enabling the diaphragm to operate said lever means in response to inhalation by a user through said mouthpiece.

14. The regulator according to claim 13 wherein said piston valve means comprises a hollow body and the piston valve means is disposed in fluid communication with said inlet means for causing air flow through the piston hollow body, said hollow body comprising means defining an outlet therein for the air flow therethrough.

15. The regulator according to claim 14 wherein said air volume control means comprises stem means, disposed within said piston hollow body, and moveable therewith, for occluding the outlet in order to vary the amount of air flow through the hollow body.

16. The regulator according to claim 15 wherein said air volume control means comprises means for moving said stem means within said piston hollow body in order to change the amount of occlusion of the outlet,, said means for moving said stem means being attached to said piston and moveable therewith by said lever means.

17. The scuba breathing apparatus according to claim 16 wherein said means for moving said stem means comprises a rotatable knob disposed on an opposite end of said balanced piston means and disposed outside either of the opposing housing means openings when said balanced piston means is attached to the housing means through the opposing housing means openings.

18. The regulator according to claim 17 further comprising a piston sleeve surrounding said piston valve means and including means, defining an air outlet therein in fluid communication with the piston hollow body outlet, for passing air from the balanced piston to the breathing chamber and preventing direct discharge of air from the piston hollow body outlet to the mouthpiece.

19. The regulator according to claim 18 wherein the piston sleeve outlet and the piston hollow body outlet are not aligned with one another.

20. The regulator according to claim 19 further comprising means for selecting an amount of force necessary for the diaphragm to operate the lever means.

21. The regulator according to claim 20 wherein said inlet means comprises swivel means for air to be introduced into the balanced piston means at an angle to a balanced piston means centerline.

22. The regulator according to claim 21 further comprising seat means, disposed in an operative position with the piston hollow body, for sealing the piston valve means; said piston valve means being sized-so that required opening and closing forces are generally independent of the air pressure of the compressed air supply.

* * * * *